US009073561B2

(12) United States Patent
Egerton

(10) Patent No.: US 9,073,561 B2
(45) Date of Patent: Jul. 7, 2015

(54) RAILROAD COUPLER MOUNT

(76) Inventor: Gary William Egerton, Silver Spring, MD (US)

( * ) Notice: Subject to any disclaimer, the term of this patent is extended or adjusted under 35 U.S.C. 154(b) by 387 days.

(21) Appl. No.: 13/286,646

(22) Filed: Nov. 1, 2011

(65) Prior Publication Data

US 2012/0267492 A1 Oct. 25, 2012

Related U.S. Application Data

(60) Provisional application No. 61/478,503, filed on Apr. 23, 2011.

(51) Int. Cl.

| | |
|---|---|
| ***B61L 15/02*** | (2006.01) |
| ***B61L 15/00*** | (2006.01) |
| ***B61G 7/00*** | (2006.01) |
| ***B61G 1/02*** | (2006.01) |
| ***B61G 5/02*** | (2006.01) |
| ***B61G 1/40*** | (2006.01) |
| ***B61G 1/32*** | (2006.01) |
| ***B61G 1/18*** | (2006.01) |
| ***B61G 7/14*** | (2006.01) |
| ***B61G 1/00*** | (2006.01) |

(52) U.S. Cl.

CPC ..... *B61L 15/0054* (2013.01); *B61G 7/00* (2013.01); *B61G 1/02* (2013.01); *B61G 5/02* (2013.01); *B61G 1/40* (2013.01); *B61G 1/32* (2013.01); *B61G 1/18* (2013.01); *B61L 15/02* (2013.01); *B61G 7/14* (2013.01); *B61G 1/00* (2013.01)

(58) Field of Classification Search

CPC ..... B61G 7/00; B61G 1/02; B61G 1/18; B61G 1/32; B61G 1/40; B61G 5/02; B61G 7/14; B61L 15/0054; B61L 15/02

USPC ..... 213/77, 88, 175, 179; 73/129, 855, 856, 73/857

See application file for complete search history.

(56) References Cited

U.S. PATENT DOCUMENTS

| | | | | |
|---|---|---|---|---|
| 2,355,544 | A | 8/1944 | McGowan | |
| 4,487,060 | A | 12/1984 | Pomeroy | |
| 4,520,662 | A * | 6/1985 | Schmid | 73/129 |
| 4,592,217 | A | 6/1986 | Fernandez et al. | |
| 4,665,858 | A * | 5/1987 | Harrigal et al. | 116/30 |
| 4,747,302 | A | 5/1988 | Goss | |
| 4,876,885 | A | 10/1989 | Martin et al. | |
| 5,131,269 | A | 7/1992 | Blosnick et al. | |
| 5,176,350 | A | 1/1993 | McQuistian | |
| 5,235,849 | A * | 8/1993 | Egerton | 73/129 |
| 5,287,739 | A | 2/1994 | Kingsbury | |
| 5,509,548 | A * | 4/1996 | Kreher | 213/77 |
| 5,873,638 | A * | 2/1999 | Bezos | 303/47 |
| 6,135,665 | A * | 10/2000 | Alfieri et al. | 403/61 |
| 2002/0162928 | A1 * | 11/2002 | Kane et al. | 248/231.51 |

(Continued)

*Primary Examiner* — Terrell McKinnon
*Assistant Examiner* — Eret McNichols
(74) *Attorney, Agent, or Firm* — Ober, Kaler, Grimes & Shriver; Royal W. Craig

(57) ABSTRACT

An improved railroad coupler mount for attaching equipment, such as an end-of-train device (EOT), marker light, test gear, etc., to a railroad coupler. The mount is comprised of a pivoting lever with brace (a V- or U-shaped notch) that grips the rib between vertically spaced coupler coring holes and a lever tip that contacts the inner wall of the coupler top coring hole, a pad that bears against the exterior face of the coupler guard arm side and a mechanism that forcibly pivots the lever tip towards the pad on an axis roughly parallel to the coupler axis.

18 Claims, 4 Drawing Sheets

(56) References Cited

U.S. PATENT DOCUMENTS

2009/0109013 A1* 4/2009 Kane et al. ..... 340/466
2010/0148013 A1* 6/2010 Bhotika et al. ..... 246/1 C
2010/0213321 A1* 8/2010 Kane et al. ..... 246/167 R
2011/0251742 A1* 10/2011 Haas et al. ..... 701/19

* cited by examiner

RAILROAD COUPLER MOUNT

CROSS-REFERENCE TO RELATED APPLICATION(S)

The present application derives priority from U.S. provisional application Ser. No. 61/478,503 filed 23 Apr. 2011.

BACKGROUND OF THE INVENTION

1. Field of the Invention

The present invention relates to improvements in railroad coupler mounts and, more particularly, railroad coupler mounts for attaching an end-of-train device (EOT), marker light, test gear, or other equipment to a railroad coupler.

2. Description of the Background

Railroad couplers are designed to connect rail cars together to form the train and generally have no provision to mount other devices or equipment. However, railroads often need to mount end-of-train telemetry devices (EOTs), marker lights, test equipment or other devices to the same railroad car coupler.

Several railroad mounts for EOTs, marker lights and/or other apparatus have been devised using the coupler knuckle or other coupler features that are active when mating two couplers together (See U.S. Pat. No. 2,355,544 to McGowan, U.S. Pat. No. 4,487,060 to Pomeroy, U.S. Pat. No. 4,592,217 to Fernandez et al, U.S. Pat. No. 4,747,302 to Goss and U.S. Pat. No. 5,287,739 to Kingsbury). However, when mating two couplers, mounts using or in close proximity to the coupler mating features prevent the couplers from mating or expose the mount and equipment to severe damage without first removing the mount and equipment from the coupler. It is desirable that a mount can remain attached to the coupler and not impede mating with another coupler and that no damage occur to the mount or equipment when mating to another coupler. Conventional railroad couplers (as shown in FIG. 1) are typically cast with four holes 2*a*, 2*b*, 3*a* and 3*b* on the guard arm face. These holes are typically arranged in two vertical pairs with two holes forward (2*a*, 3*a*) and two holes further back along the horizontal length of the coupler (2*b*, 3*b*). The top and bottom sets of holes each connect with a horizontal passage, and the passages are separated with a horizontal rib (4*a*, 4*b*). These coring holes and passages are only designed to facilitate the coupler casting process and lessen the coupler weight, but are otherwise unused in normal coupler operations. Several railroad coupler mounts have been devised to use these coring holes and passages as a means of attachment to the couplers.

For example, U.S. Pat. No. 4,520,662 to Schmid, U.S. Pat. No. 4,665,858 to Harrigal et al, U.S. Pat. No. 4,876,885 to Martin et al, U.S. Pat. No. 4,691,563 to Martin, U.S. Pat. No. 5,131,269 to Blosnick et al and U.S. Pat. No. 5,176,350 to McQuistian show a variety of claw-like and other mechanisms that lengthwise span adjacent coring hole pairs, thereby anchoring the mount to side-by-side coupler holes. However, (as seen in FIG. 1) the span between 2*a*/2*b* and 3*a*/3*b* is typically much wider than the narrow 2*a*/3*a* and 2*b*/3*b* span. Coring hole geometry is not standardized and there is broad variation from coupler to coupler of the lengthwise coring hole span, but vertical coring holes are consistently separated with a ½ to 1" thick rib. Mounts that grip the side-by-side coring holes are larger and heavier than mounts using vertical coring holes because of the additional lengthwise span and the greater adjustment stroke needed to compensate for lengthwise span variability. Consequently, mounts that employ coring hole anchors large enough to span lengthwise coring hole pairs are inevitably heavy and often protrude beyond the equipment to be mounted, and this makes carrying the equipment more difficult. Dismounted equipment is often carried at the user's side, and the propensity of the protruding mount to bump the user's leg or catch on clothing presents a safety hazard. Safety and ergonomics make it desirable that a coupler mount eliminate or minimize protrusions beyond the width of the equipment and that the mount be as light weight as possible.

U.S. Pat. No. 5,235,849 to Egerton and U.S. Pat. No. 6,135,665 to Alfieri, et al use a hook or finger that fits into a single top coring hole. Fitting into a single core hole helps to keep the mount compact, but the mounts require the hook or finger to react with additional mount components (the jaw in the '849 patent or 2nd and 3rd fingers in the '665 patent) that bear on the coupler rib. These additional mount components must be independently fabricated from the hook or finger and complicate manufacture of the mount. U.S. Pat. No. 6,588,966 to Kane, et al. show expanding jaws that fit to the top and bottom edges of a vertical pair of coring holes. This keeps the mount compact, but both jaws must pivot to fit variable coupler hole geometry, and the device requires multiple scissor arms with multiple pivots or a geared screw to actuate, which complicates manufacture of the mount. All of these devices are actuated by screws that must be rotated by hand many turns to move the hook, finger or jaws through the range of motion. This makes installation or removal of the mounts slow and tedious.

What is needed is a simple, inexpensive, lightweight and reliable mount that facilitates quick and easy installation and removal from a coupler, and which does not interfere with any coupler mating features so as to allow mating to another coupler without removing the EOT.

SUMMARY OF THE INVENTION

It is therefore the object of the invention to mount to the coupler in a fashion that does not impede the mating of another coupler and avoids damage to the mount and equipment when mating another coupler.

Another object of the invention is to facilitate safety and ergonomics by being sufficiently compact to remain within or minimize protrusion from the width of mounted equipment and to be light weight.

Yet another object of the invention is to easily and quickly install to and remove from a coupler and to easily manufacture the device.

According to the invention, the coupler mount clamps to a vertical pair of coupler coring holes with a pivoting lever fixed to the frame of the mount and that rotates on an axis roughly parallel to the coupler axis. The mount includes a pad which bears against the exterior coupler guard arm face and a means to forcefully pivot the lever. The lever bears on both the top coupler coring hole and the rib between a vertical pair of coupler coring holes. A U- or V-shaped notch on the lever grips the coupler rib, and the lever pivots on this notch while using the coupler rib as a fulcrum. When the lever is forcefully pivoted clockwise, the lever tip is driven against the inner lip of the top coupler coring hole. The pad is arranged to contact the exterior of the coupler at a point above the lever tip contact point inside the coupler coring hole. This offset distance between contact points creates a moment that drives the lever notch tightly against the rib to firmly clamp the mount to the coupler guard arm face.

In a preferred embodiment, installation is facilitated by spring loading the lever to rotate counter-clockwise with the lever tip in the open position. The lever tip may then be readily inserted or withdrawn from coupler coring holes, and resting the weight of the equipment on the lever will pivot the lever clockwise to a substantially closed position. The mount then latches in position and can be fully tightened in place with only a few turns of a screw.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Figure 1:
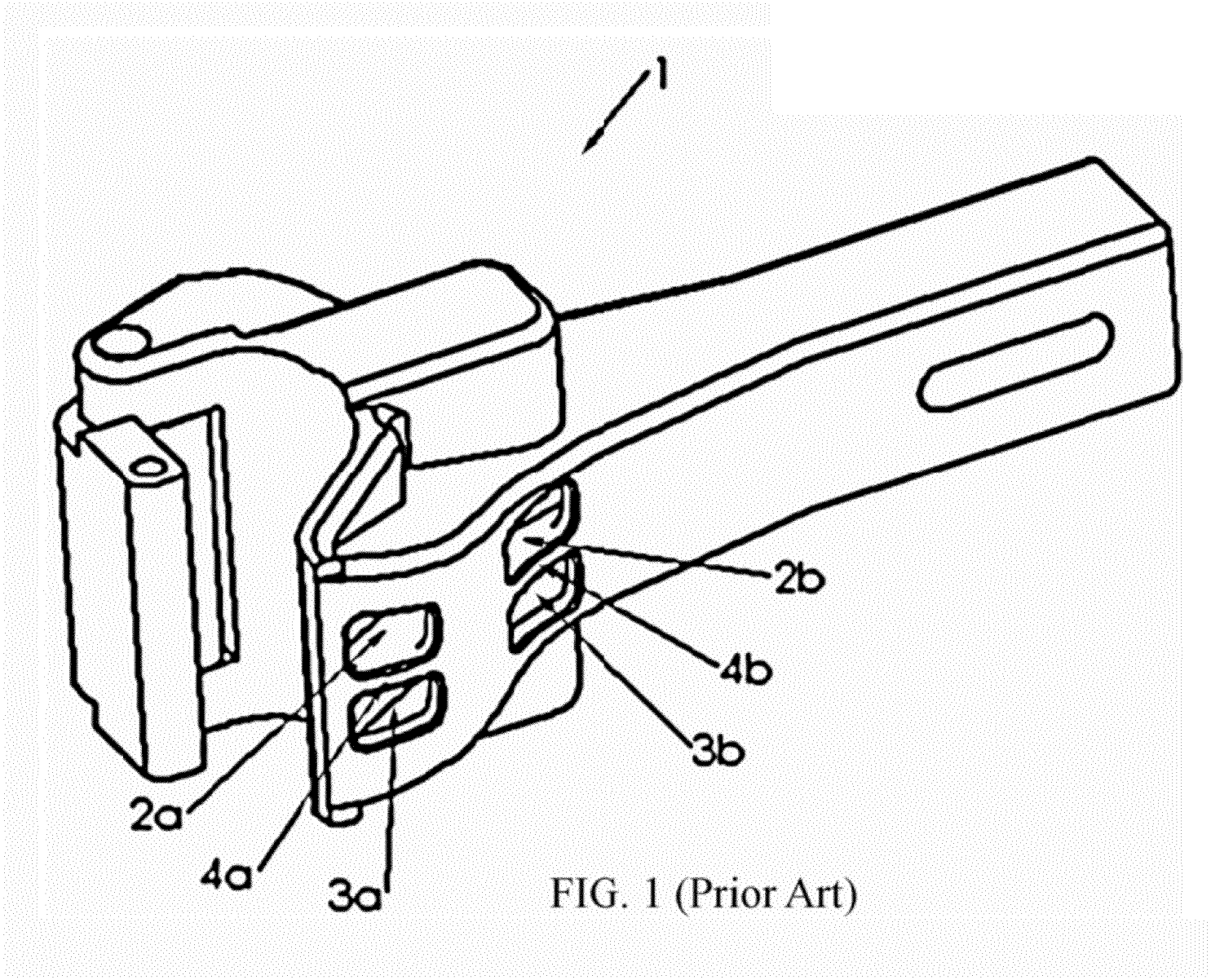
FIG. 1 (Prior Art)
FIG. 1 is a perspective view of a conventional railroad coupler as commonly used in the railroad industry.

The present invention is an improved railroad coupler mount for attaching an end-of-train device (EOT), marker light, test gear, or other equipment to a conventional railroad coupler (e.g., as shown in FIG. 1), having at least one vertical pair of coring or relief holes and intermediate rib on the guard arm face such as 2*a*, 3*a* and 4*a* or 2*b*, 3*b* and 4*b*. The improved railroad coupler is low-profile and does not impede coupler-to-coupler juncture, nor is it in any way exposed to possible damage during coupler-to-coupler juncture. The improved railroad coupler improves safety and ergonomics.

Figure 2:
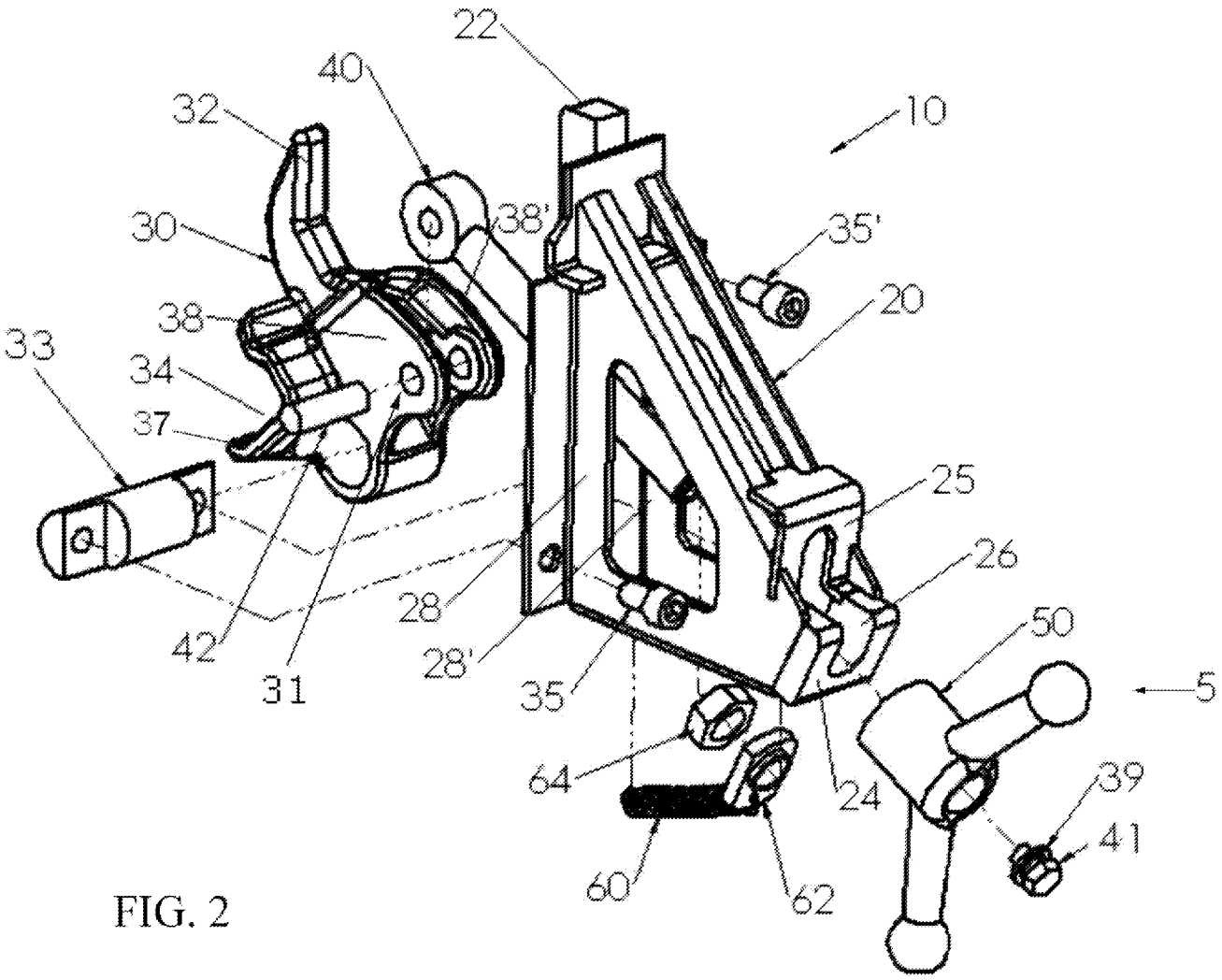
FIG. 2 is an exploded view of a preferred embodiment of the coupler mount according to the present invention.

FIG. 2 is an exploded view of the coupler mount 10 according to a preferred embodiment. The components described herein may be formed of any suitable material that is strong and stiff enough to sustain the clamping loads of the mount and impact forces typically experienced by equipment on a moving train, and steel is presently preferred.

The coupler mount 10 generally comprises a lever 30 pivotally engaged to a mount frame 20 via pin 33. Pin 33 is fixed to the frame 20 by bolts 35 and 35' or other suitable securing means, allowing lever 30 to rotate about an axis substantially parallel to the longitudinal axis of the coupler. Alternatively, pin 33 may be it simple bolt or axle held captive in frame 20. The lever 30 is forcefully pivoted by a screw mechanism 5 or other suitable mechanism for clamping the lever 30 to the coupler. The illustrated screw mechanism 5 is a manual screw as will be described, but other mechanisms such as a pneumatic cylinder, hydraulic cylinder, etc. will suffice for clamping the mount to a coupler. As seen in FIG. 2, a handle 50 is threaded onto one end of an eyebolt 40, the eyebolt 40 being threaded along a portion of its length. The eyebolt 40 runs to an eye at the other distal end, and the eye engages a yoke 31 on lever 30 with pin 42. Manually rotating the handle 50 causes the handle 50 to bear against a frontal stop 24 of frame 20, thereafter pulling lever 30 and forcibly pivoting it clockwise to firmly clamp the mount 10 to the coupler.

Figure 4:
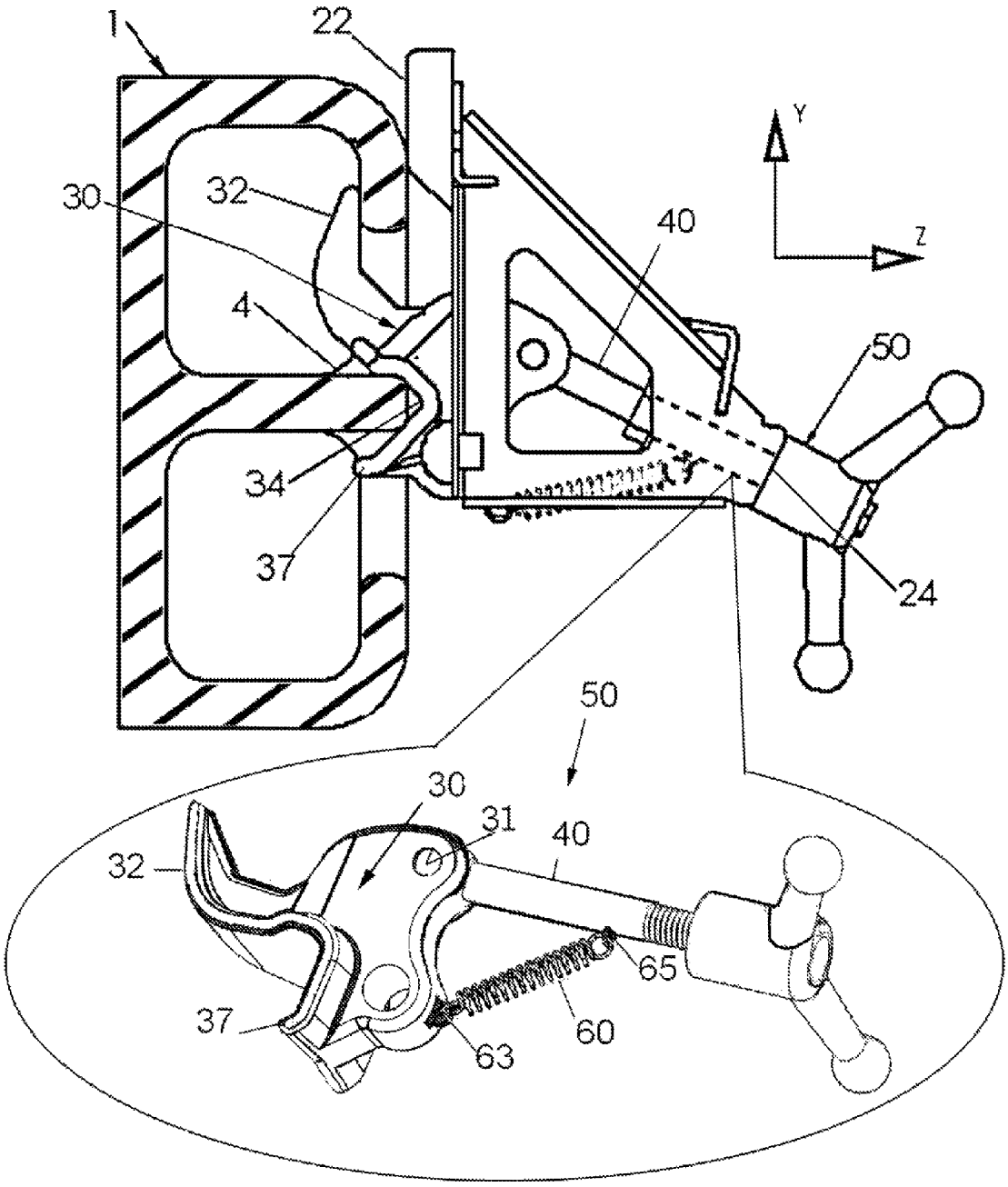
FIG. 4 depicts the improved coupler mount of FIGS. 2-3 in the CLOSED position and clamped to a cross section of a coupler.

The lever 30 extends an angular talon-shaped finger 32 outward and upward into the interior of the coupler coring hole. The lever 30 is also defined by a brace 34 for engaging the horizontal rib 4 occurring between coupler coring holes. As illustrated, the brace 34 ma be a U- or V-shaped notch 34 occurring beneath the finger 32 and is made several inches wide by an angled flange 37. The brace 34 and flange 37 together with the finger 32 provide gripping surfaces that mate with or contact both the coupler rib and coupler interior. When firmly clamped to the coupler as shown in FIG. 4, coupler rib 4 is seated in brace 34 and acts as the fulcrum for lever 30. It is noteworthy that the lever 30 design allows all the mount features that contact the coupler (brace 34, flange 37 & finger 32), except pad 22, to be made as a single component. Fabricating the lever 30 as a single part improves manufacturability and minimizes production tooling. Coupler mounts using, separate components that independently grip the coupler rib and coupler interior require multiple parts to be fabricated and tooled for production.

Referring again to FIG. 2, lever 30 must pivot through an angle sufficiently wide to permit easy installation and removal of lever finger 32 and the brace 34 into the coupler coring holes. This normally entails considerable screw travel along eyebolt 40, and significant turning of handle 50 to install or remove the mount 10. Handle 50 can be made to spin freely on the eyebolt 40 thread. Manually spinning. handle 50 will then rapidly traverse the travel required to clamp or unclamp the mount. Note that a screw 41 and washer 39 are affixed to the end of the eyebolt 40 to prevent loss of the handle 50.

The illustrated embodiment provides another mechanism to permit more rapid installation and removal of lever finger 32 and braze 34 into the coupler coring holes. Eyebolt 40 traverses an elongate slotted hole 26, and a second tier stop 25 is provided above the stop 24. Handle 50 can pivot on eyebolt 40 about pin 42 to an OPEN position above step 24 or to a CLAMPING position abutting step 24. To OPEN the lever 30 for installation or removal of the mount from a coupler, handle 50 is turned counterclockwise to slightly loosen eyebolt 40. Handle 50 is then lifted above the first-tier frame stop 24, moving eyebolt 40 to the top of slotted hole 26, and reseated against the second-tier stop 25.

The above-described OPEN/CLAMPING action can be facilitated by spring-loading lever 50 to pivot counter-clockwise, thereby ensuring a constant pre-bias of handle 50 against stop 24 or stop 25. Spring-loading is accomplished by a spring 60 having one end fixed to either the frame 20 or the base of lever 30 and the other end fixed to eyebolt 40. As seen in FIG. 2, spring 60 may be attached to the threaded section of eyebolt 40 by a threaded tab 62 and lock nut 64. Threaded tab 62 engages the threads of eyebolt 40 and provides a means for anchoring the spring 60 thereto. Threaded tab 62 is affixed in position by tightening lock nut 64. The other end of spring 60 is affixed to frame 20 or the base of lever 30. Alternately, as seen in FIG. 4, spring 60 may be attached between the eyebolt 40 and lower portion of lever 30 by stirrups 63, 65 attached to both the lever 30 and eyebolt 40. Either way, spring loading of lever 30 counter-clockwise also prevents an accidental shift of handle 30 from the OPEN position to the CLAMPING position. Handle 50 will stay in the OPEN position until handle 50 is pulled or lever 30 is pivoted with sufficient force to overcome the spring tension and must be deliberately moved by an operator.

Spring-loading lever 30 counter-clockwise eases installation of the mount 10. When handle 50 is in the OPEN position, the lever finger 32 is best oriented for easy insertion into or removal from the coupler top coring hole. Further, once the lever finger 32 is fully inserted, the lever 30 can rest on the coupler rib and the weight of the mount 10 and equipment will pivot the lever 30 nearly closed and move the eyebolt 40 threaded end out of the frame 20. Note this action is "hands-free" and allows operator to continue holding the equipment with both hands without directly contacting any mount component. In this condition, the handle 50 can freely spin to rapidly tighten the mount 10 when a single fixed stop is used, or the handle 50 will automatically latch over stop 24 when multi-tiered stop 24/25 is used. Thereafter, the handle 50 need be forcefully rotated only a few turns to fully tighten the mount 10 to the coupler.

The frame 20 is defined by opposing frame walls 28 and 28' and the lever flanges 38, 38' slide inside frame 20 with a close fit. Lever pivot pin 33 appears to carry the off-axis torsion loads from the lever 30, however, when the lever 30 is in the closed or CLAMPED position, the close fit of the lever flanges 38 and 38' inside the frame walls 28 and 28' help transmit lever torsion loads to the mount frame 20. Thereby, pin 33 need not resist the full off-axis torsion loads and the durability of the mount is increased.

Figure 3:
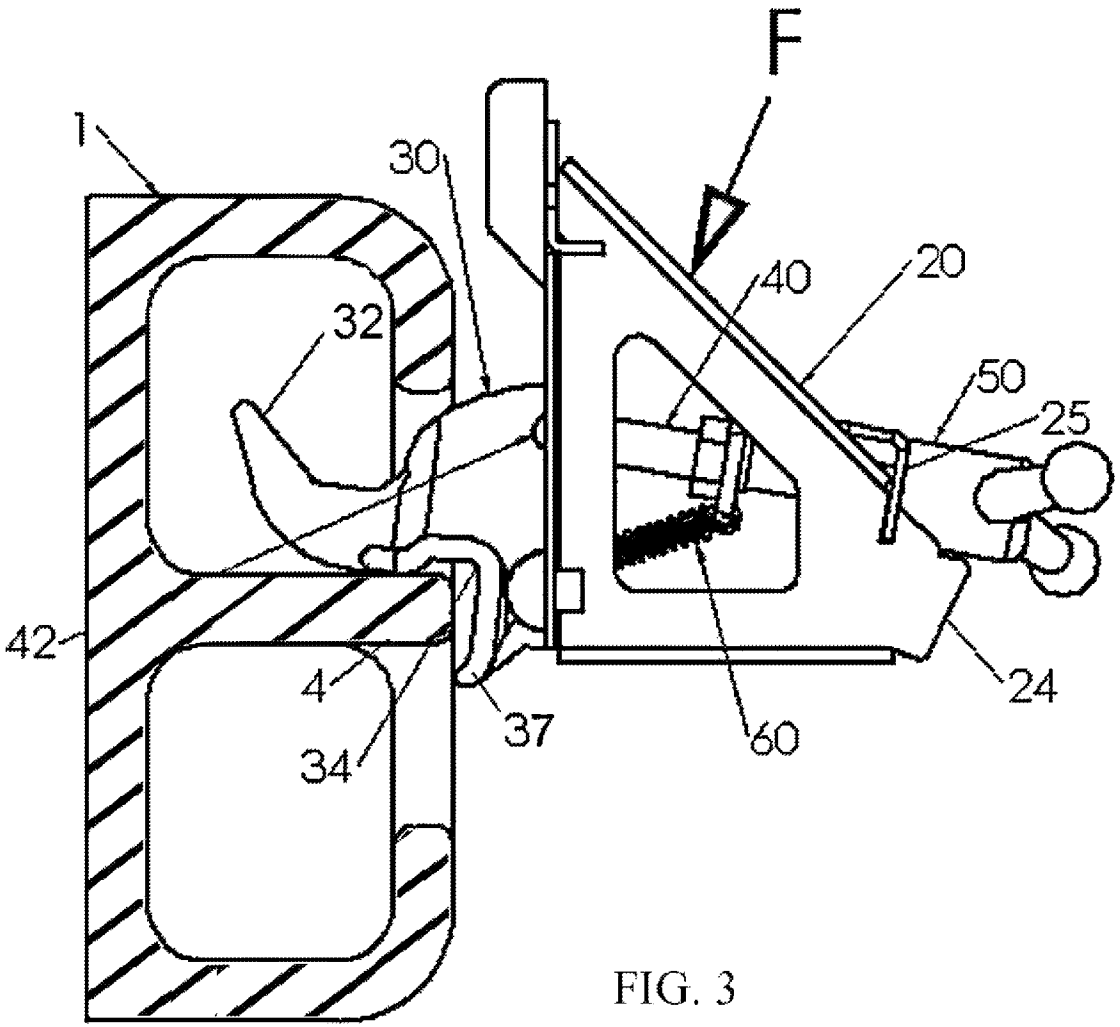
FIG. 3 depicts the improved coupler mount of FIG. 2 in the OPEN position while installing or removing the mount from a cross section of the coupler coring holes.

FIG. 3 is a side view illustrating the mount 10 undergoing installation to or removal from a coupler. The mount 10 is here shown in the OPEN position with the handle 50 above step 24 and contacting stop 25. The lever finger 32 is inserted into the top coring hole of one of the vertically spaced coring hole pairs (typically found on a railroad coupler), with the brace 34 resting on the coupler rib 4. The coupler rib 4 acts as a fulcrum for lever 30, and downward force F on the mount frame 20 will cause lever 30 to pivot about coupler lib 4 and move lever finger 32 towards the top interior wall of the top coupler coring hole. The downward force required to pivot lever 30 is abetted by the weight of the mount 10 and whatever device it supports. Eyebolt 40 pushes handle 50 out of the mount frame 20 until the handle 50 clears step 24 on the frame. Spring 60 pulls eyebolt 40down and the eyebolt 40 pivots on in 42 to drop handle 50 over step 24 and latch the mount 10 loosely to the coupler. The handle 50 is now in the CLOSED position. Handle 50 is screw threaded to eyebolt 40, and rotating the handle 50 forcibly rotates lever 30 as the handle bears against frame step 24. Operators tighten handle 50 until the mount is clamped firmly to the coupler.

FIG. 4 shows the mount 10 in the CLOSED position and firmly clamped to the coupler mount coring hole. The lever finger 32 forcibly bears against the top interior wall of the top coring hole. To provide an upper bearing surface, a bearing pad 22 may be fixed to the back of the frame 20 via welds or otherwise. Pad 22 contacts the exterior coupler guard arm face at a point above the lever finger 32 interior contact point. When the lever 50 is forcefully pivoted, the offset distance between the exterior pad 22 point-of-contact and interior lever finger 32. point-of-contact drives the brace 34 tightly against the coupler rib 4 and firmly clamps the mount to the coupler.

To successfully clamp firmly to the coupler, the mount 10 must resist rotational and translational loads about all three X, Y & Z axes. The lever 30, frame 20 and screw mechanism 5 (components 40, 50 and 42 or other urging means) are all sufficiently stiff and strong to maintain tight clamping of the mount to the coupler face as the mount undergoes X axis torsion loads and X, Y and Z axis translational loads. In addition, the brace 34 (V- or U-shaped notch) with flange 37 is made sufficiently wide to grip the coupler rib 4 over a span of several inches. This broad width ensures the mount can resist Y and Z axes torsion loads.

The mount 10 is removed from the coupler by reversing the installation steps previously described. Handle 50 is turned to loosen the eyebolt and lifted above step 24. The mount frame is lifted to relieve force on lever 30, such that spring 60 tension will pivot lever 30 counter-clockwise and pull handle 50 against stop 25. The mount is now in the OPEN position and the lever finger 32 can be pulled from the coupler coring hole.

It should now be apparent that the above-described coupler mount is low-profile and no wider than a coring hole width. This narrow profile permits keeping the coupler mount within the confines of the equipment width and minimizes or eliminates protruding hardware. This makes hand-carrying the equipment with mount 10 attached much easier and safer than equipment with wide, protruding mounts. In addition, the compactness of the lever, frame and associated mechanism permits the mechanism to be lighter in weight, especially when compared to competing mechanisms that attempt to span horizontally opposed coring holes.

The lever 30 pivots through a wide angle/range to facilitate easy removal and release of the mount from couplers. The mount will quickly latch to the coupler and can be fully tightened with just a few turns of the handle 50, and reversing the process will quickly remove the mount from the coupler.

Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A railroad coupler mount assembly for attachment to a railroad car coupler head comprising a vertical pair of coring holes separated by an intermediate rib having an upper surface, lower surface and exposed edge on a guard arm face of said railroad coupler head, the railroad coupler mount assembly comprising:

a frame having an abutment for bearing against an exterior surface of the railroad coupler;

a lever connected at one end to said frame by a first pivotal connection for rotation about an axis, said lever having a brace formed with a flange defining an open furrow facing away from said first pivotal connection, said furrow of said flange being sized to therein receive and capture the exposed edge of said intermediate rib to provide a fulcrum about which said lever rotates, a finger extending a length away from said first pivotal connection for abutting interior of said vertical pair of coring holes, and a coupling section between said finger and brace providing a second pivotal connection, said lever including said brace, said finger and said coupling section;

an extension/retraction mechanism connected between said frame and the coupling section of said lever for selectively moving said lever between a clamped position in which the lever is fixedly clamped to the vertical pair of coring holes and rib of said railroad coupler by said finger and brace, and an unclamped position in which the lever can be removed from the vertical pair of coring holes and rib of said railroad coupler.

2. The railroad coupler mount assembly according to claim 1, wherein said lever coupling section further comprises opposing flanges extending to a yoke for coupling to a pivot pin.

3. The railroad coupler mount assembly according to claim 2, wherein said yoke is offset from said brace and said finger by said flanges.

4. The railroad coupler mount assembly according to claim 3, wherein said finger is crooked at an angle formed along its length.

5. The railroad coupler mount assembly according to claim 1, further comprising a stationary pin fixedly attached to said frame, lever being pivotally connected to said pin.

6. The railroad coupler mount assembly according to claim 1, wherein said furrow formed in said brace comprises one of a V shaped indentation or a U shaped indentation.

7. The railroad coupler mount assembly according to claim 1, wherein said extension/retraction mechanism is actuated by a manual-turn handle.

8. The railroad coupler mount assembly according to claim 7, wherein said extension/retraction mechanism comprises an elongate member connected between said frame and the coupling section of said lever.

9. The railroad coupler mount assembly according to claim 8, wherein said frame has opposing sides defining an interior, and said elongate member extends within the interior of said frame between the opposing sides and pivotally attaches to the coupling section of said lever.

10. The railroad coupler mount assembly according to claim 9, wherein said frame comprises a first-tier stop for seating said handle a first predetermined distance from said axis, and a second-tier stop for seating said handle a second predetermined distance from said axis, said second predetermined distance being shorter than said first predetermined distance.

11. The railroad coupler mount assembly according to claim 10, wherein said second-tier stop is adjustable.

12. The railroad coupler mount assembly according to claim 7, wherein said handle is screw-threaded onto said elongate member.

13. The railroad coupler mount as recited in claim 12, where rotation of the handle about said elongate member selectively extends or retracts said elongate member relative to said handle.

14. The railroad coupler mount assembly according to claim 1, further comprising a spring attached between said elongate member and one of said frame or said lever for biasing said lever toward said unclamped position.

15. A railroad coupler mount assembly for attachment to a vertical pair of coring holes and rib on a face of a railroad coupler, said rib having an upper surface, lower surface and exposed edge on a guard aim face of said railroad coupler, the railroad coupler mount assembly, comprising:

a frame;

a lever connected at one end to said frame by a first pivotal connection for rotation about an axis, said lever having a brace formed with a flange defining an open furrow facing away from said pivotal connection, the furrow of said flange being sized to therein receive and capture the exposed edge of said intermediate rib to provide a fulcrum about which said lever rotates, a finger extending a length away from said first pivotal connection, and a coupling section between said finger and brace providing a second pivotal connection;

an extension/retraction mechanism connected from said frame to a second pivotal connection located between said brace and finger for selectively moving said lever between a clamped position and an unclamped position.

16. The railroad coupler mount assembly according to claim 15, wherein said extension/retraction mechanism comprises an elongate threaded member connected between said frame and the coupling section of said lever, and a threaded handle screw-inserted onto said elongate member.

17. The railroad coupler mount assembly according to claim 16, wherein said frame comprises a first-tier stop for seating said handle a first predetermined distance from said axis, and a second-tier stop for seating said handle a second predetermined distance from said axis.

18. The railroad coupler mount assembly according to claim 16, further comprising a spring attached between said elongate member and said frame or lever for spring biasing said lever toward said unclamped position, thereby holding the lever tip in a position that enables easy insertion and removal from a coupler coring hole.

* * * * *